US010800016B2

(12) United States Patent
Paquin et al.

(10) Patent No.: US 10,800,016 B2
(45) Date of Patent: Oct. 13, 2020

(54) TOOL FOR INSTALLING PROTECTIVE AND DECORATIVE TUBING AROUND WIRES

(71) Applicant: ABBA DADDY LLC, Woodstock, GA (US)

(72) Inventors: Priscilla Sue Paquin, Woodstock, GA (US); Christopher J. Paquin, Woodstock, GA (US)

(73) Assignee: ABBA DADDY LLC, Woodstock, GA (US)

( * ) Notice: Subject to any disclaimer, the term of this patent is extended or adjusted under 35 U.S.C. 154(b) by 594 days.

(21) Appl. No.: 14/939,120

(22) Filed: Nov. 12, 2015

(65) Prior Publication Data

US 2016/0133358 A1 May 12, 2016

Related U.S. Application Data

(60) Provisional application No. 62/078,618, filed on Nov. 12, 2014.

(51) Int. Cl.
*B25B 27/14* (2006.01)

(52) U.S. Cl.
CPC ..... *B25B 27/14* (2013.01)

(58) Field of Classification Search
CPC ..... B25B 27/14; H04R 1/1033; H02G 1/08; H02G 1/00; H02G 3/0481; G02B 6/502
See application file for complete search history.

(56) References Cited

U.S. PATENT DOCUMENTS

| | | | | |
|---|---|---|---|---|
| 4,593,442 | A * | 6/1986 | Wright | B25B 27/0092 29/235 |
| 5,884,901 | A | 3/1999 | Schilling | |
| 6,655,014 | B1 | 12/2003 | Babini | |
| 2001/0040045 | A1 | 11/2001 | Shak | |
| 2003/0173555 | A1* | 9/2003 | Supkis | B65H 57/12 254/134.3 R |
| 2004/0049913 | A1 | 3/2004 | Dukes et al. | |
| 2004/0134559 | A1 | 7/2004 | Huang | |

OTHER PUBLICATIONS

International Search Report and Written Opinion; dated Jun. 9, 2016; for PCT/US15/60306; 11 pgs.

* cited by examiner

*Primary Examiner* — Lee A Holly
(74) *Attorney, Agent, or Firm* — Gardner Groff & Greenwald, PC

(57) ABSTRACT

A tool for mounting a protective sleeve onto a wire. According to example forms, the protective sleeve is resiliently-flexible and longitudinally-slitted and the wire is in the form of an audio cable. The tool includes a tube-mounting assembly and a wire holder. According to some example forms, the tool includes a handle for grasping the tool during use. In some example forms, the wire is in the form of a charging cable.

12 Claims, 12 Drawing Sheets

TOOL FOR INSTALLING PROTECTIVE AND DECORATIVE TUBING AROUND WIRES

CROSS-REFERENCE TO RELATED APPLICATIONS

This application claims the benefit of U.S. Provisional Patent Application Ser. No. 62/078,618 filed Nov. 12, 2014, the entirety of which is hereby incorporated herein by reference for all purposes.

TECHNICAL FIELD

The present invention relates generally to protecting and organizing electrical wires of electronic devices such audio headphones, and particularly to tools for installing tubing protectors/organizers onto electrical wires.

BACKGROUND

The use of earphones and headphones is widespread. Such products are used to listen to music, to communicate through a telephone, to watch movies, to aid hearing-impaired individuals, and a multitude of other activities. The most common headphones and earphones used include a pair of ear-pieces and a pair of flexible wires extending between the ear-pieces and the electronic device. Through continued use and transition between storage and operation, these wires oftentimes become tangled or broken to the point at which they are no longer operable or useful.

Accordingly, it can be seen that there exists a need for solutions for preserving the wires that extend between headphone and earphone ear-pieces and an electronic device to which they are secured. And it can be seen that there exists a further need for a way of installing such preserving solutions onto the wires or other cables, cords, strings, etc. It is to the provision of solutions to these and other problems that the present invention is primarily directed.

SUMMARY

Generally described, in one aspect the present invention relates to a device and method for accessorizing and organizing wires that are used in conjunction with audio equipment, for example ear-phones and headphones. The device has a hollow core and an elongated slit that is separable to receive the wires within the core. The device is also flexible.

In a first example embodiment, the invention relates to a method for protecting a length of flexible audio wire. The method includes providing at least one elongated hollow tube with a core that is sized to receive the wire and with a longitudinal slit that provides access to the tube core. The tube is resiliently flexible transversely so that the longitudinal edges defining the longitudinal slit resiliently deflect between a closed position immediately adjacent each other (in a generally "O" shape in cross section) and an open position forming an access channel through which the wire can be inserted and removed (in a generally "C" shape in cross section). And the tube is resiliently flexible axially such that it can flex with the wire but is stiffer (less flexible) than the wire so that in the absence of other (e.g., user-applied) forces it resiliently biases the wire toward a straightened arrangement. The method also includes receiving the length of flexible audio wire within the hollow tube core through the resiliently-separable slit.

In another example embodiment, the invention relates to a sleeve for protecting a length of flexible audio wire. The sleeve includes an elongated hollow tube with a core, an opening at each end and a slit extending between the opening at each end. The slit includes a pair of opposing parallel edges that are resiliently separable.

In another example embodiment, the invention relates to a method for protecting a length of flexible audio wire. The method includes providing at least one elongated hollow tube with a core and a resiliently-separable slit providing access to the tube core. The tube includes material that is more rigid than the length of flexible audio wire and is axially-flexible in 360 degrees along a longitudinal axis. The method includes separating the slit to expose the hollow tube core and receiving the length of flexible audio wire within the tube core through the resiliently-separable slit.

In another aspect, the present invention relates to a tool for installing the wire-protector tubing on and around the wire.

In yet another aspect, the present invention relates to a tool for mounting a resiliently-flexible, longitudinally-slitted, protective tube onto a flexible audio wire including a tube-mounting assembly and a wire holder. The tube-mounting assembly includes a tube spreader and a spread-tube holder in series with each other. The wire holder includes a wire-holder channel that slidingly holds the wire. In example forms when in use, advancing the tube into engagement with the tube spreader opens the tube slit, advancing the spread-open tube along the spread-tube holder retains the tube slit open, advancing the spread-open tube across the wire-holder channel and the wire held therein positions the tube on the wire, and advancing the spread-open tube past the tube-release point frees the tube slit to close around the wire.

In another aspect, the invention relates to a skinner tool for securing a protective sleeve to a wire, the protective sleeve including a longitudinal slit running the length thereof, the skinner tool including a tube-mounting assembly and a wire holder. The tube-mounting assembly having a tube spreader and a spread-tube holder. The wire holder generally has a channel for holding the wire relative to the tube-mounting assembly. In example forms, the protective sleeve is advanced relative to the tube-mounting assembly such that the tube spreader and the spread-tube holder displace the slit running the length of the protective sleeve at a position generally adjacent an end portion of the channel of the wire holder, and wherein advancing the protective sleeve in a tube-advancing direction and when the wire is at least partially within the protective sleeve and movable along the channel of the holder allows for positioning of the wire within the protective sleeve, and wherein after the engagement thereof whereby the wire is positioned within the protective sleeve, further advancement of the protective sleeve causes disengagement with the spread tube holder, thereby freeing the slit to close around the wire.

In yet another aspect, the present invention relates to a method of covering a wire with a protective sleeve. The sleeve includes a generally uniform slit extending the length thereof, the slit generally being configured such that in a neutral position, the slit is generally in closed. The method includes providing a tool having a tube-mounting assembly and a wire holder, the tube-spreader assembly having a tube spreader and a spread-tube holder, the wire holder having a channel for holding the wire relative to the tube-mounting assembly; positioning the wire within the channel of the wire holder, the wire being movable relative to the channel; positioning the protective sleeve such that an end thereof engages the tube-spreader and the spread-tube holder of the tube-mounting assembly; moving the protective sleeve relative to the tube-mounting assembly; positioning the wire exiting an end of the channel to be positioned within the protective sleeve, the slit being displaced to an access position when the wire exiting the end of the channel is entering the protective sleeve; and moving the protective sleeve relative to the tube-mounting assembly while the wire is moved through the channel of the wire holder and through an opening of the slit in the access position, wherein after the slit passes an end portion of the spread-tube holder, the slit generally moves back to a neutral position with the slit closed and substantially covering the wire therein.

The specific techniques and structures employed to improve over the drawbacks of the prior devices and accomplish the advantages described herein will become apparent from the following detailed description of example embodiments and the appended drawings and claims.

DETAILED DESCRIPTION OF EXAMPLE EMBODIMENTS

Figure 5:
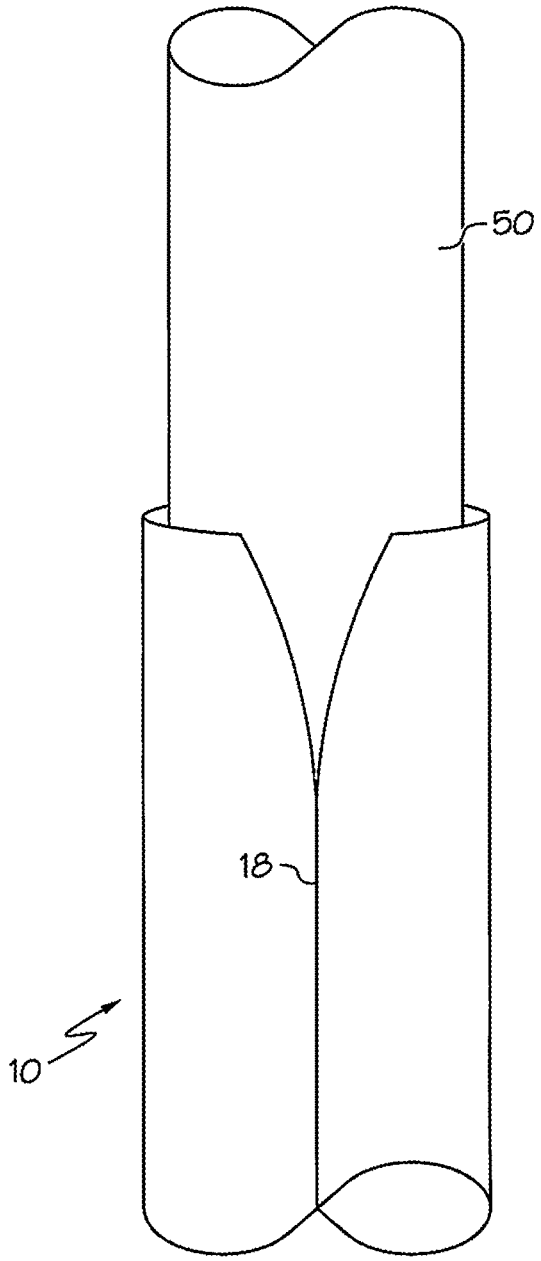
FIG. 5 shows an isolated and enlarged view of the wire-protector shown in FIG. 1, being inserted upon and surrounding a wire.
Figure 6:
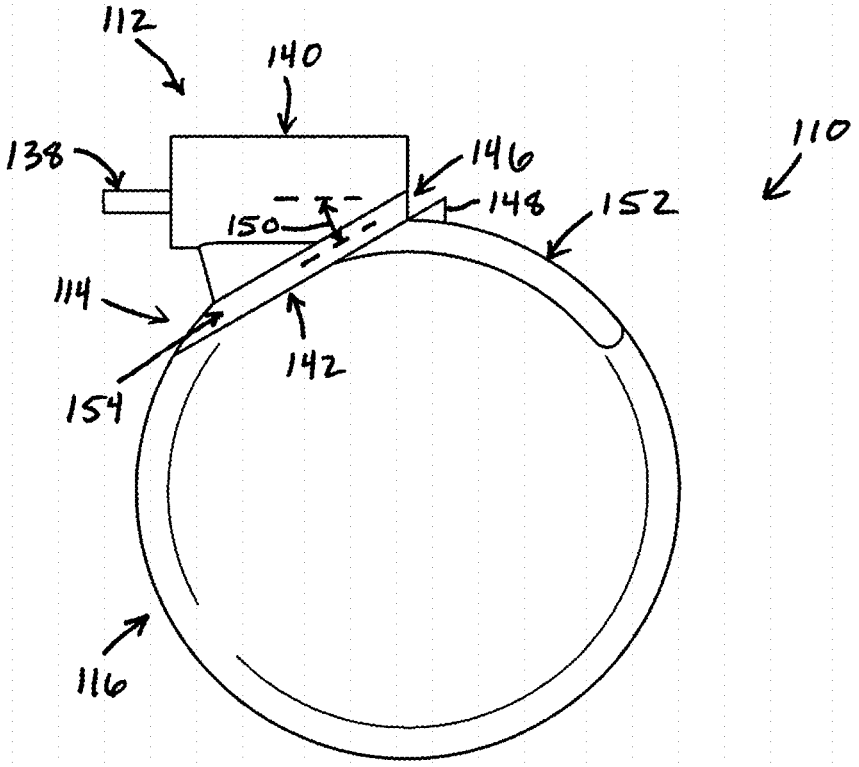
FIGS. 6-11 show a mounting tool according to another example embodiment of another aspect of the invention, with the tool designed for installing the wire-protector of FIGS. 1-5 on and around the wire of FIGS. 1-5.
Figure 7:
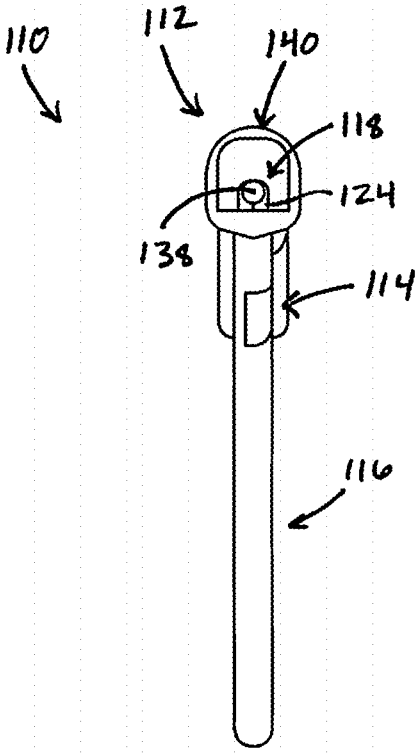
Figure 8:
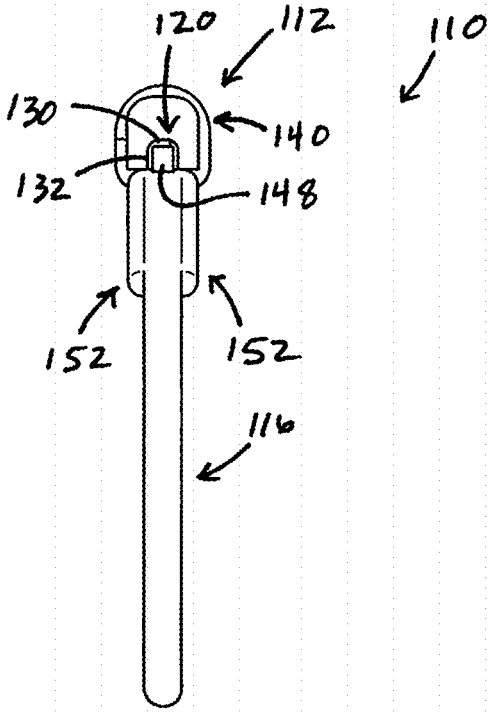
Figure 10:
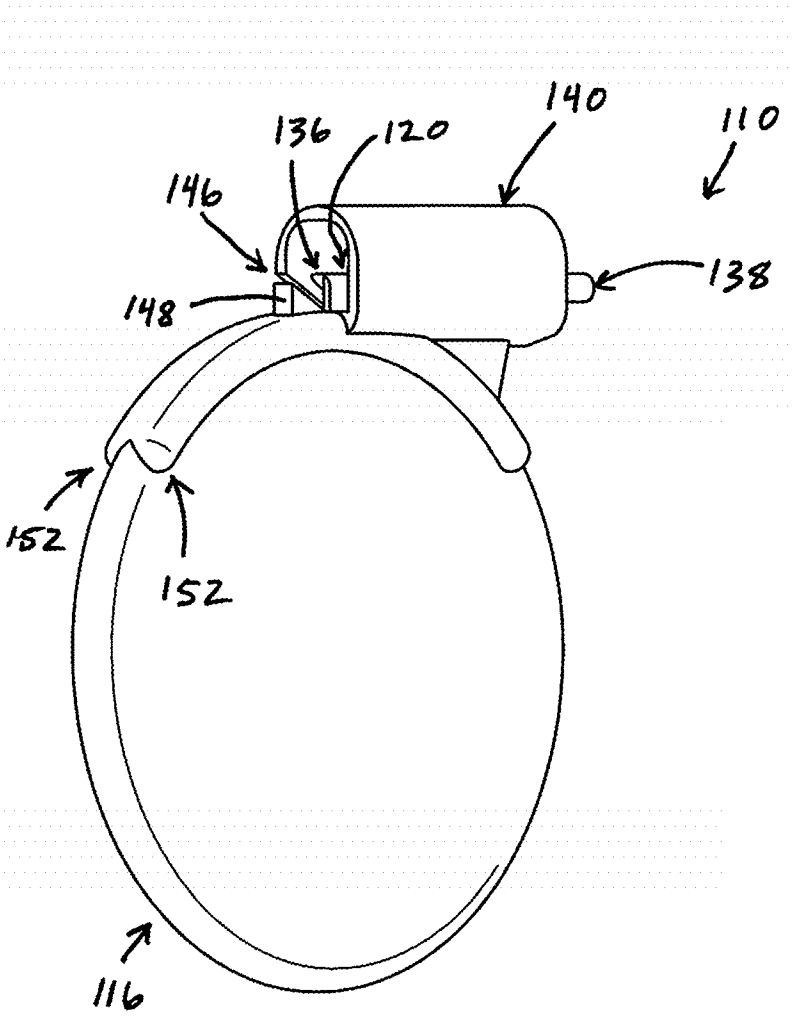
Figure 9:
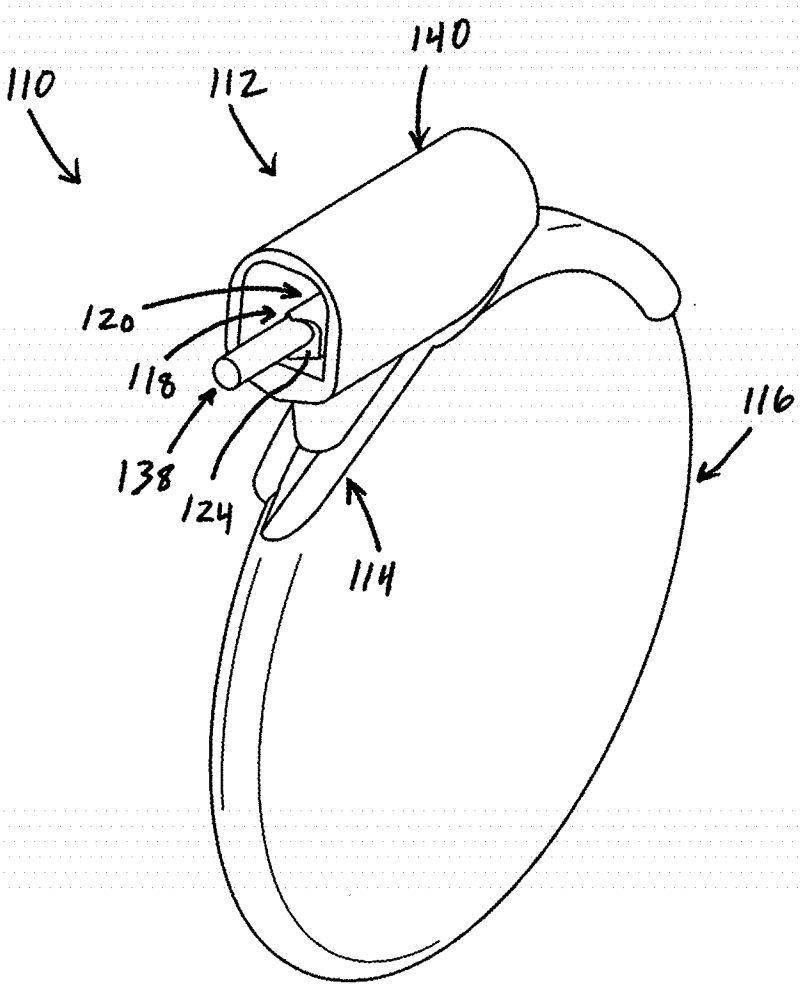
Figure 11:
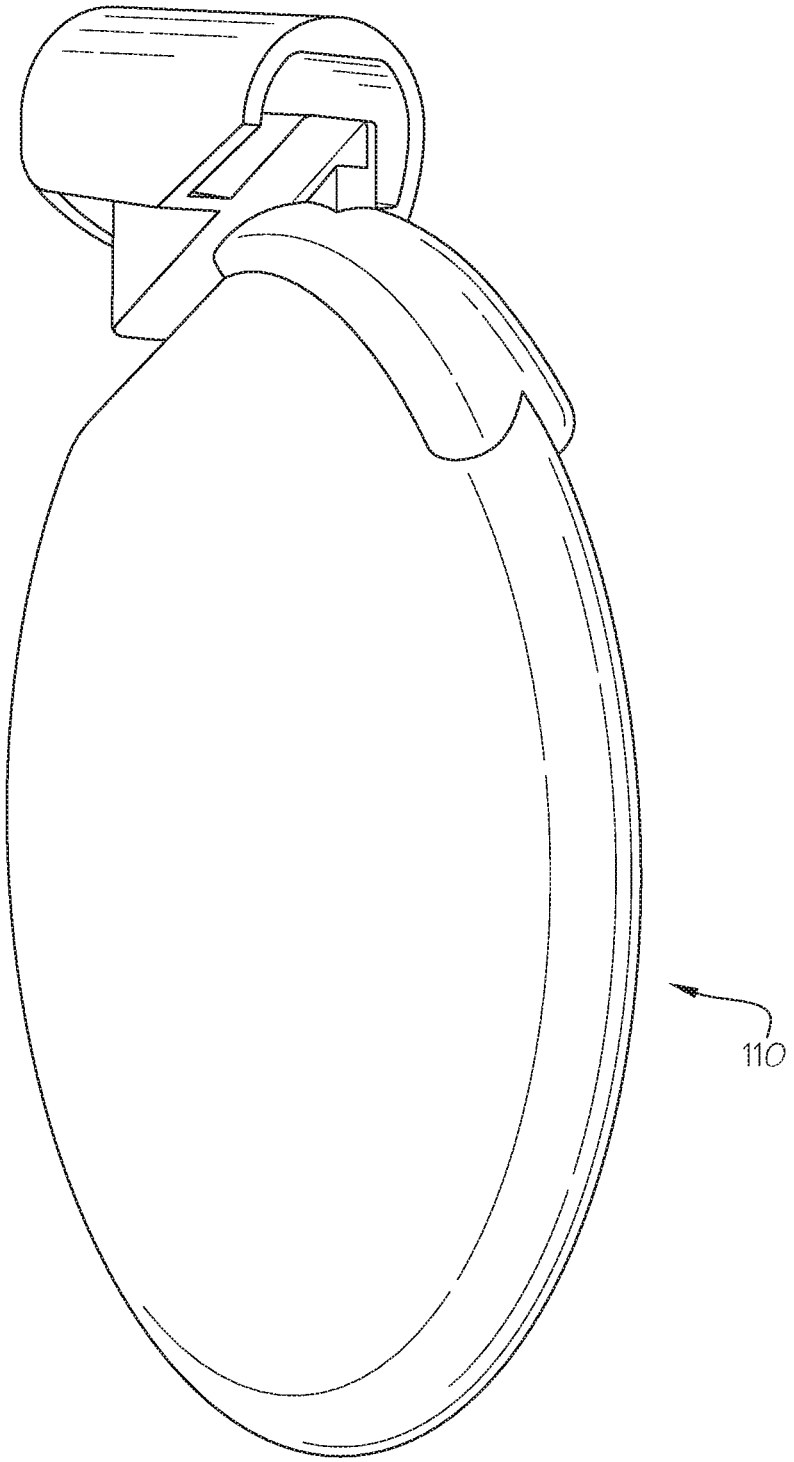

Generally described, in one aspect the present invention relates to a device and method for accessorizing and organizing wires that are used in conjunction with audio equipment, for example ear-phones and headphones. As shown in FIG. 5, the device 10 includes an elongated tube-shape with a hollow interior and openings at each end. An elongated slit 18 extends the length of the tubing 10. The tubing 10 can be made of any durable and flexible material, for example plastic, more specifically polyurethane. The tubing 10 can alternatively be manufactured from PVC, rubber, vinyl, polypropylene, thermoplastics, silicone, any cloth material such as nylon, cotton, or like materials. Alternatively, the tubing 10 can be manufactured from a desired synthetic or natural material, or combination thereof. The tubing 10 is configured to be flexible in 360 degrees along a longitudinal direction, and the tubing is designed to be less flexible than a common earphone or headphone wire. So, at rest the tubing 10 is configured to naturally return to an uncoiled or straightened state. Alternatively, the tubing 10 can be wrapped around an object, for example a cellular telephone or portable audio device. Because of these characteristics, the tubing 10 prevents the wires from becoming tangled during use or storage.

Figure 2:
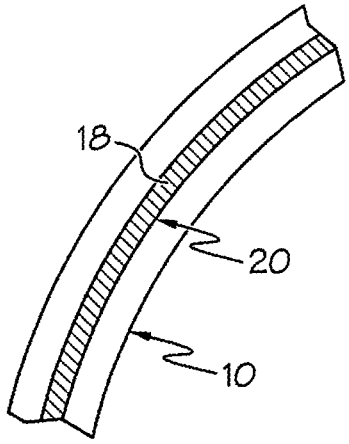
FIG. 2 shows an enlarged and isolated view of the wire-protectors shown in FIG. 1.

As shown in FIG. 2, the slit 18 is designed to close together in a relaxed state. So, at rest either elongated edge along the slit 18 will touch the opposite edge. The tubing is also flexible 360 degrees in an axial direction perpendicular to the length of the tubing. This allows a user to separate the edges of the slit 18 to widen the gap as shown in FIG. 5. As shown, the section of the slit 18 at the end of the tubing 10 can be pulled apart so that the wire 50 can be inserted within through the slit and into the interior of the tubing. Once the wire 50 is within the interior of the tubing 10, the tubing naturally compresses onto the wire and the width of the slit 18 narrows shut to close, or at least narrow, the gap.

Figure 3:
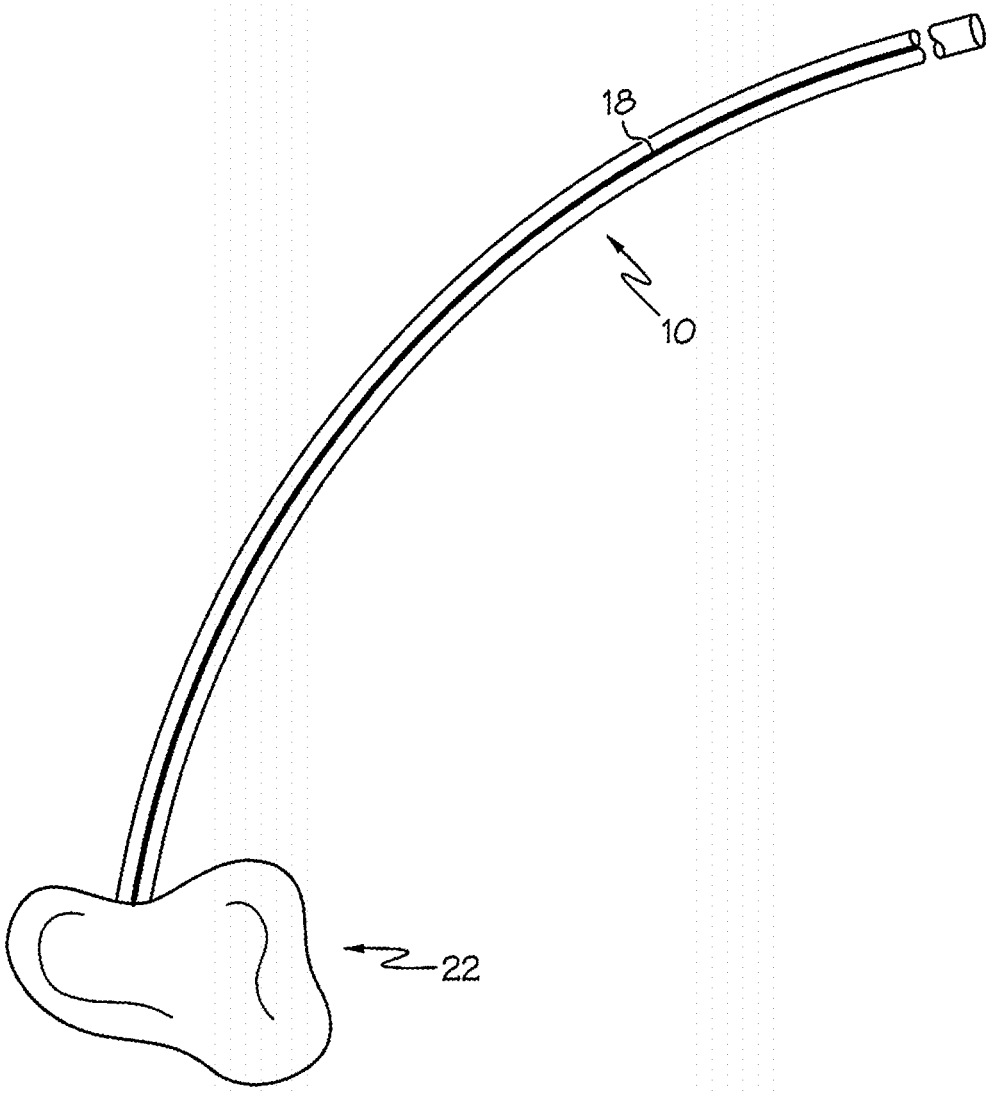
FIG. 3 shows the wire-protectors shown in FIG. 1, in use with an in-ear monitor.

Preferably, the tubing 10 is designed to fit snugly around the wire 50. Further, the dimensions of the tubing 10 can vary depending upon the wire it is designed to protect. For example, the tubing 10 can have a greater inner diameter in order to contain and snugly fit a thicker wire, and vice versa. Specifically, the interior surface of the tubing 10 can be designed to contact the outer surface of a corresponding earphone wire. Preferably throughout the length of the tubing 10, the distance between the inner diameter and the outer diameter remains constant. Alternatively, the oppositely-facing edges along the slit 18 can have a narrower thickness than the remaining sections of the tubing 10. Specifically, the edges can narrow to a tip. The length of the tubing 10 can also vary depending on the wire 50 it is secured to. Preferably, the tubing 10 is designed to cover and protect the entire length of a wire from the ear-piece 12, 22, 40 (as shown in FIGS. 1, 3 and 4).

Figure 1:
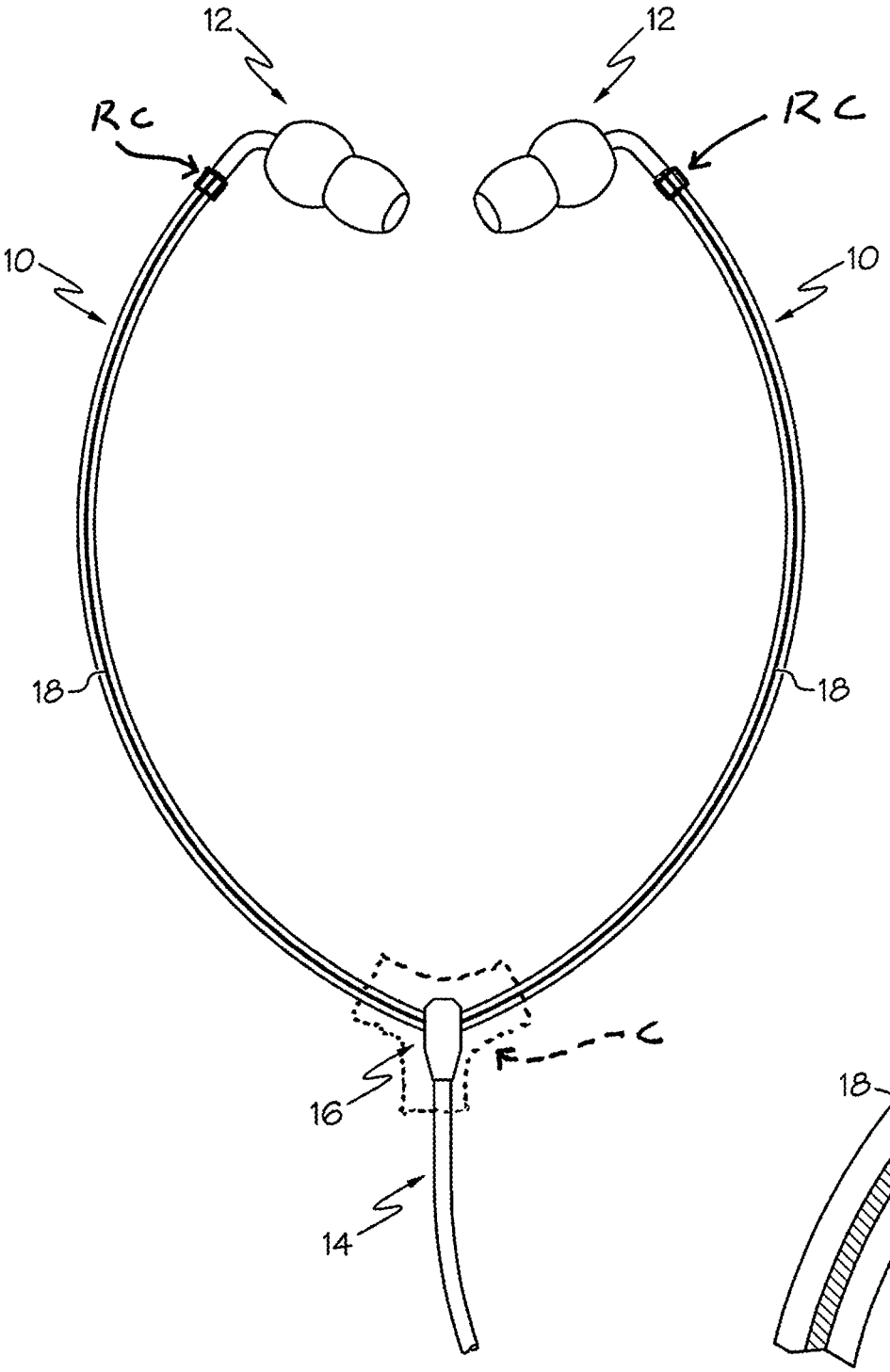
FIG. 1 shows an embodiment of the wire-protectors according to a first example embodiment of one aspect of the invention, in use with a set of ear phones.
Figure 4:
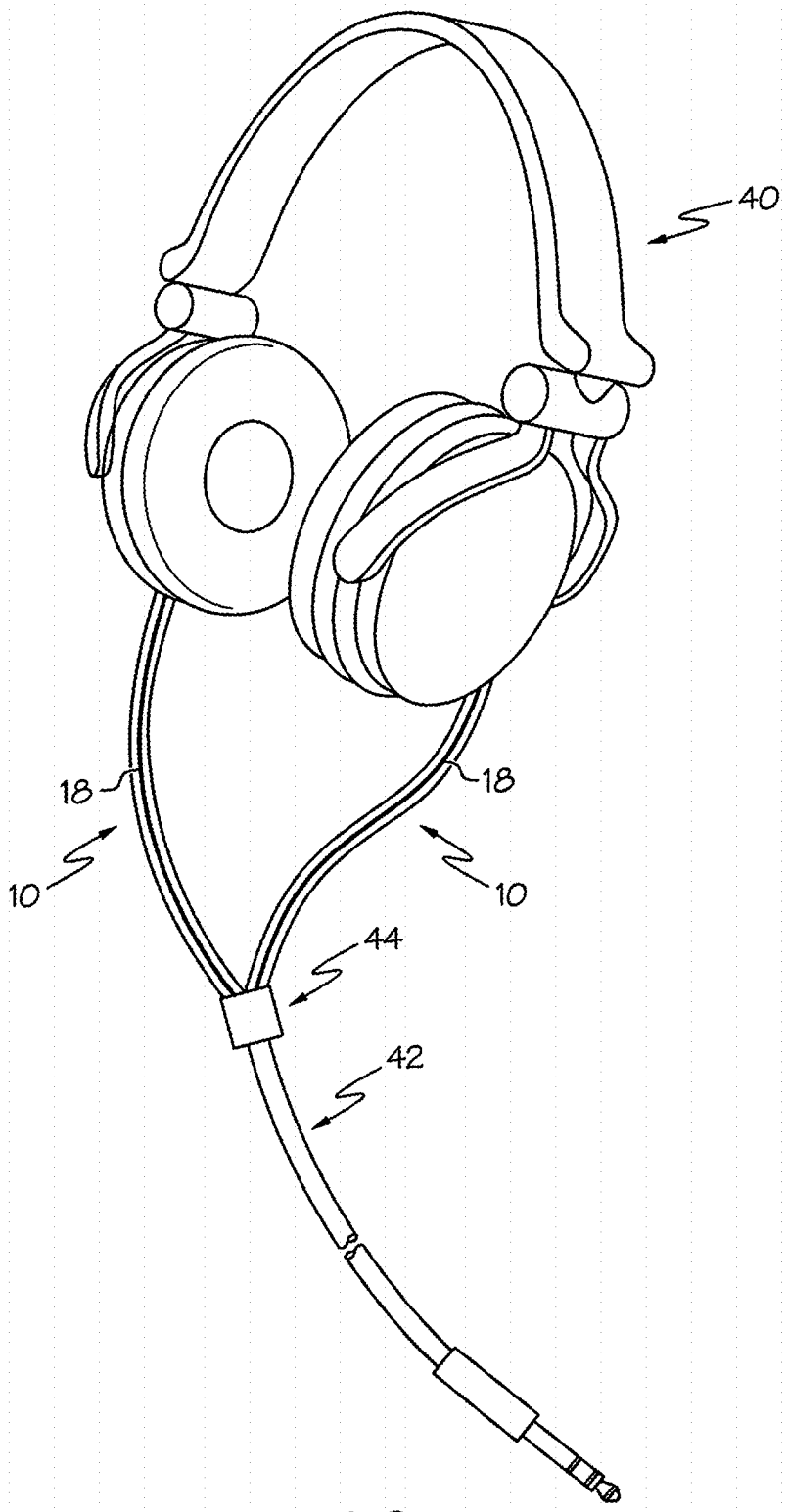
FIG. 4 shows the wire-protectors shown in FIG. 1, in use with a set of headphones.

In the examples shown in FIGS. 1 and 4 the tubing 10 is designed to protect most commercially-available earphone 12 and headphone 40 designs, which have two separate wires extending from the ear-piece and then joining into a connected cord 14, 42 beginning at a connector 16, 44. Preferably, the tubing 10 is designed to extend between the ear-piece 12, 40 and the connectors 16, 44. As shown, two tubes 10 are used in order to protect the wires of the head phones 40 and ear phones 12. Alternatively, a tube device could be designed to extend the entire length of a wire from the ear-piece to the input jack. Optionally, a connector or cover member C may be provided for substantially covering the connector 16, 44 while engaging portions of the tubing 10 that are covering the two separate wires extending to the ear pieces. In example forms, the cover member C may be personalized to comprise one or more colors, graphics, photos, designs, indicia, etc. According to some example forms, the cover member C may be shaped and sized as desired, for example, wherein the overall shape thereof can be formed to resemble a logo, cross, animal or the like. In some example forms, the cover member C generally comprises a body defining a generally Y-shaped opening or bore or passageway therein and wherein at least a portion of the cover member C is generally capable of providing access to the void space such that the connector 14, 44 and the wires extending therefrom can be positioned therein. Optionally, the cover member C may be formed from one or more components or shells having one or more interengagement or coupling features to cover or provide engagement with the connector 16, 44. According to one example embodiment, the cover member C is generally shaped like a medallion and comprises one or more features thereon to provide personalization to the user's headphones while also securing the ends of the tubes such that the slit thereof is incapable of being displaced to cause disengagement of the wire from the tubing. According to some example forms, the size of the passageway is at least configured to provide engagement with the ends of the tubing, for example, to secure the ends thereof shut such that the tubing remains engaged with the wire.

According to some example forms, one or more clamps, end collars or resilient spring-like couplings RC may be provided at the ends of the tubing 10 (see FIG. 1) whereby the clamp RC generally tightens around the ends of the tubing generally adjacent the ear-piece 12. Preferably, the slit remains closed together, and thus, prevents the wire therein from becoming removed therefrom, or for example, such that inadvertent catching of an end portion of the tubing to cause separation of the slit and thus, disengagement of the wire from the tubing, is substantially eliminated.

Alternatively still, the tubing 10 material can provide a visual accessory to the wires. For example the tubing 10 can be made of illuminescent, or glow-in-the-dark, material. The material can alternatively be a variety of colors or opaque shades. The cords could further have shiny or glittery exteriors.

FIGS. 6-16 show a skinner or mounting tool 110 according to an example embodiment in another aspect of the invention. The tool 110 can be used to install the wire-protector tubing 10 on and around the wire 50 for use with headphones (intended broadly to cover all wearable audio listening devices including in-ear headphones such as insertable ear-buds, on-ear earphones such as clip-on earbuds, and on-ear headphones). The tool 110 can also be used to install other elongated, hollow, longitudinally-slitted, resiliently-flexible tubes on electrical wires for other electric devices (e.g., chargers) and/or on structures other than electric wires (e.g., telephone cords, picture-hanging wire). For example, according to one example embodiment, the tool 110 is generally sized to provide for installation of a protective sleeve on a charging cable, for example, such as an APPLE USB charging cable or charging cables of the like (e.g., for electronic devices, smart phones, tablets, etc.). In example forms, the protective sleeve may comprise indicia, designs, or other graphics, colors or designs to provide a user with a personalized charging cable. According to some example forms, by providing a protective sleeve on the charging cable, the user thereof is less likely to lose or misplace the cable, and/or another person is less likely to mistakenly take the cable since the cable has a personalized sleeve thereon. Further optionally, other cables or tethers such as the string connecting two ear plugs together may be provided with the protective sleeve, and thus, the tool 110 is preferably configured for positioning the string tethering the ear plugs together within the protective sleeve.

FIGS. 6-11 show details of the structure of the mounting tool 110. The tool 110 includes a tube-mounting assembly 112, a wire holder 114, and a handle 116. These major components can be made of plastic or other conventional materials using molding or other conventional fabrication equipment and techniques. And these major components can be made together as a single integral piece or some or all of them can be made separately and assembled together.

Figure 12:
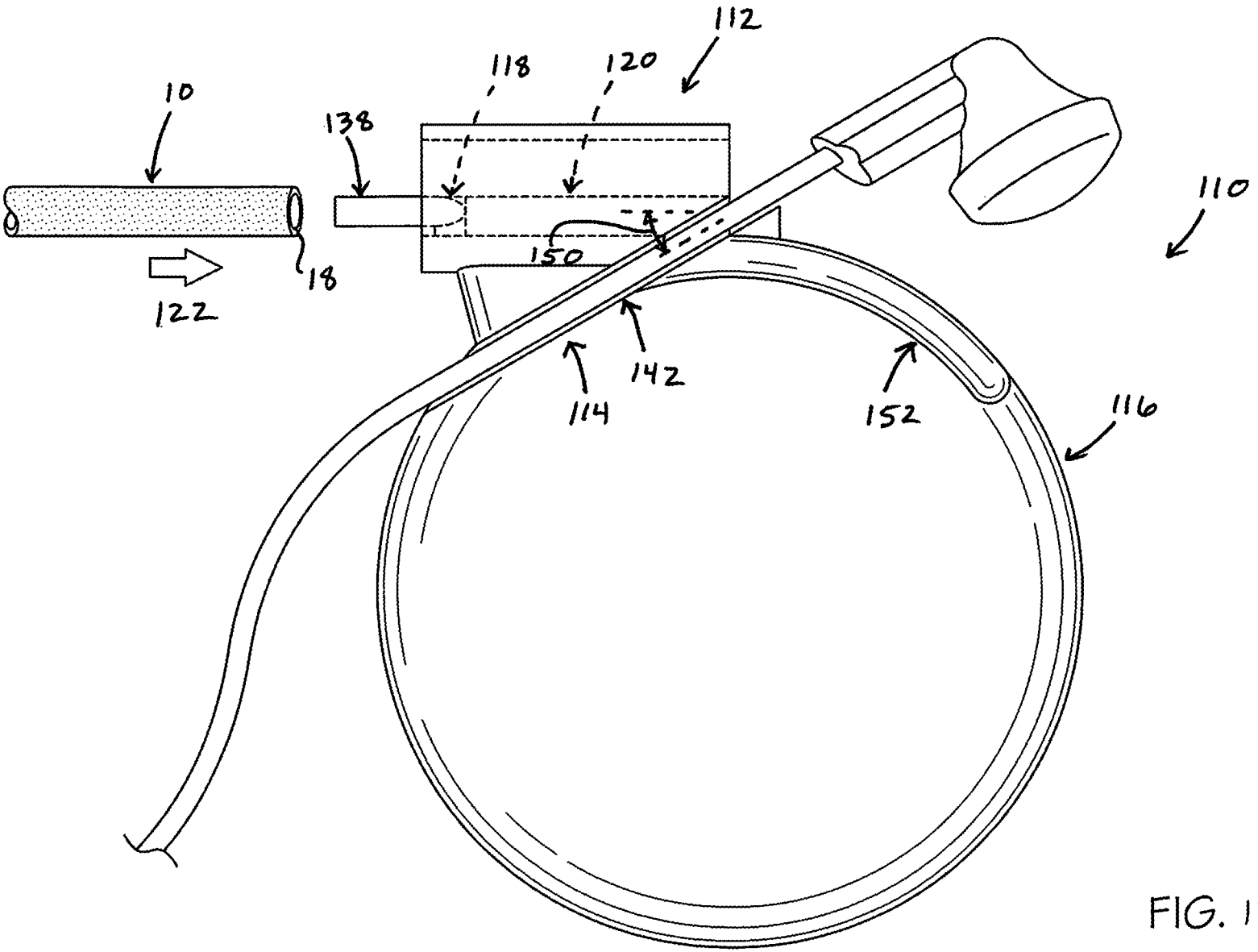
FIG. 12 shows a side view of the mounting tool of FIGS. 6-11 whereby the wire has been received within the wire holder and an end of the wire-protector being generally adjacent a tube feed of the mounting tool.

The tube-mounting assembly 112 includes a tube spreader 118 and a spread-tube holder 120 arranged in series (in-line) with each other with the spreader in rear of the holder (in a forward direction 122 of an advancing tube 10 being installed onto a wire 50 as shown in FIG. 12). The tube spreader 118 includes at least one transversely-ramped surface 124 such that it is transversely wider along its length in the tube-advancing direction 122 so that it is received in the tube slit 18 and then spreads open the tube slit as the tube is advanced along it (see also FIGS. 13A-B). The at least one transversely-ramped surface 124 can be curved (concave or convex), linearly angled, etc. For example, in the depicted embodiment the tube spreader 118 includes two symmetrical transversely-ramped flat surfaces 124 forming a relatively narrow rear 126 that is receivable in the elongate slit 18 of the tube 10 and a relatively wide front 128 that is wider than the wire 50. The transversely-ramped surfaces 124 can be formed by a wedge member (as depicted) or formed in another manner for example by rods, pins, wings, bars, or other transversely-ramped structures. In some embodiments, the slit 18 forms a notch (e.g., V-shaped) at the leading edge of the tube 10 to facilitate receiving the ramped surfaces 124.

The spread-tube holder 120 receives the spread-open tube 10 around it to hold open the spread tube while permitting the spread tube to be slid/advanced axially in the tube-advancing direction 122 toward the wire 50. The spread-tube holder 120 is positioned immediately forward of the tube spreader 118 in the tube-advancing direction 122, for example it can extend directly from the tube spreader, as depicted. The spread-tube holder 120 includes a first axially-extending peripheral portion 130 around which the spread tube 10 is received and a second axially-extending peripheral portion 132 with a transverse width that is wider than the wire 50 so that (by mechanical interference with the tube longitudinal edges) it holds the slit 18 spread open (see also FIGS. 14A-C). For example, the spread-tube holder 120 can have a generally semi-cylindrical solid shape, with its first peripheral portion 130 (e.g., top-positioned) generally curved to receive the curved tube 10 around it with a close fit, and with its second peripheral portion 132 (e.g., bottom-positioned) having the same (or substantially the same) width as the tube-spreader wide front 128, as depicted. The spread-tube holder 120 has a rearward portion 134 adjacent the tube spreader 118 and a forward portion 136 through which the wire holder 114 extends (as described below), together typically forming an elongate shape.

In addition, the tube-mounting assembly 112 can optionally include a tube feed 138 and a tube retainer 140. In the depicted embodiment, for example, the tube feed 138 is a generally cylindrical rod arranged in series and in-line with the tube spreader 118 and the spread-tube holder 120, positioned rearward of and extending from the tube spreader, and having an outer diameter that is less than the inner diameter of the tube 10. In this way, the tube 10 can be slid onto the tube feed 138 so it is transversely stable as it is axially advanced into engagement with the tube spreader 118. In some embodiments the free end of the tube feed is tapered to facilitate easy sliding of the tube onto it. In addition, the depicted tube retainer 140 is a generally cylindrical hollow shell surrounding at least a portion of the tube spreader 118 and the spread-tube holder 120. In this way, the shell-like tube retainer 140 mechanically interferes with and thus stops the spread tube 10 from transversely "popping" off of the spread-tube holder 120 due to the transverse resiliently of the longitudinally-slitted spread-open tube.

Figure 16:
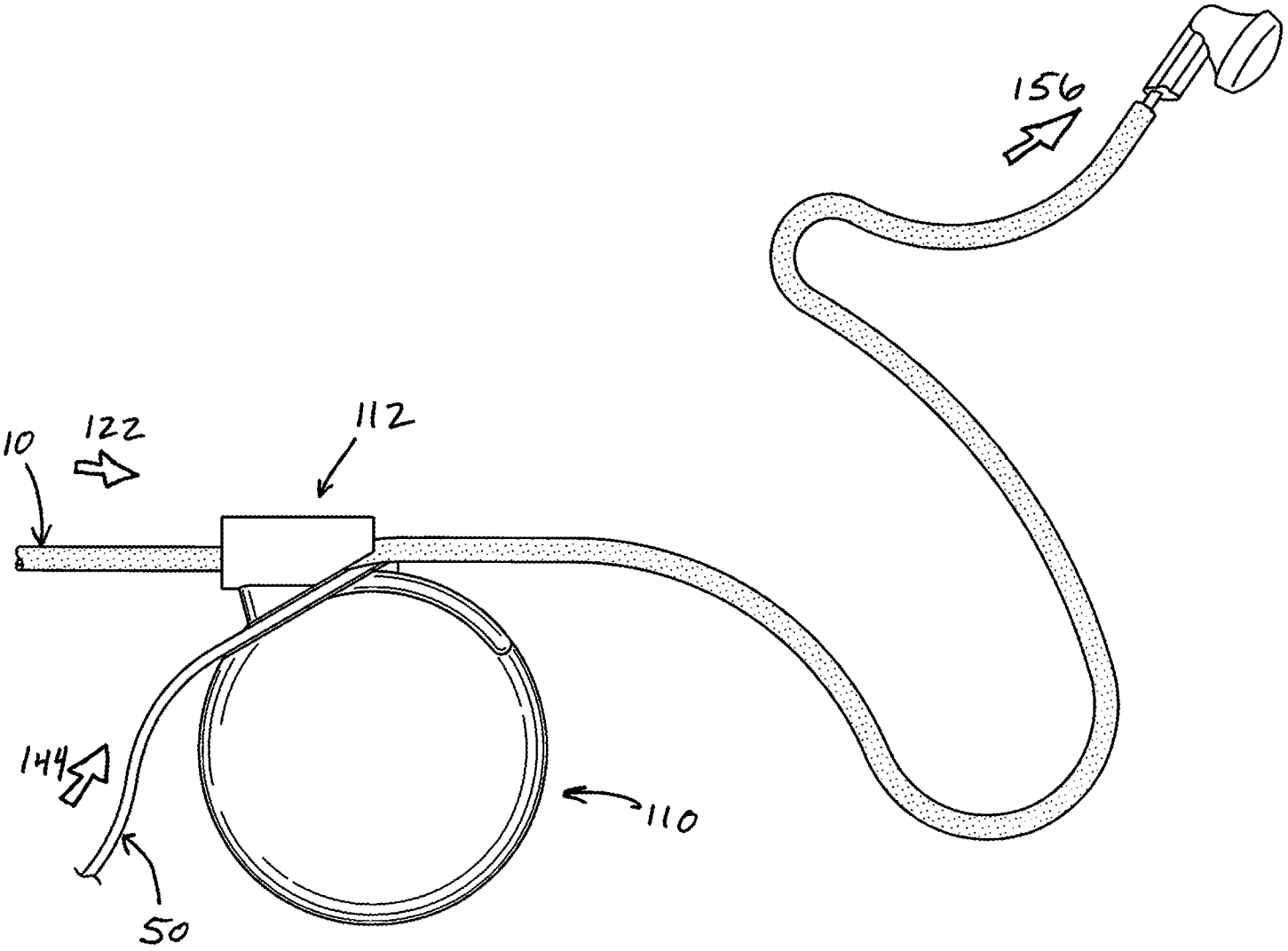
FIG. 16 shows the side view of FIG. 15A, wherein the wire-protector and the wire have been further advanced through the mounting tool.

The wire holder 114 includes a channel 142 that slidingly receives the wire 50 in it so that the wire is transversely stable while permitting the wire to be forwarded axially in an advancing direction 144 toward the tube 10 (see FIG. 16). The wire-holder channel 142 can be formed by a continuous recess (as depicted), by spaces between opposing tabs, clips, or other projections of the wire holder, or by other structures. The wire-holder channel 142 includes a mounting portion 146 that extends through the forward portion 136 of the spread-tube holder 120 along which the spread-open tube 50 is advanced. In this way, as the spread-open tube 50 is advanced forward along the forward portion 136 of the spread-tube holder 120, the spread-open tube is slid onto the mounting portion 146 of the wire-holder channel 142 and thus also onto the wire slidingly held by it.

A forward edge 148 of the forward portion 136 of the spread-tube holder 120 then functions as a release point (or surface or other structure), that is, because there is no more structure of the spread-tube holder 120 to hold the tube slit 18 open, the tube 10 is free to resiliently close around the wire 50. Thus, the mounting portion of the wire-holder channel extends through and across the forward portion 136 of the spread-tube holder 120 rearward of its forward-edge tube-release point 148. The spread-tube holder forward-release point 148 can be in the form of a transverse endwall (as depicted), a wedged-shaped member, a conic member, other tapered or ramped structures, or the like. In addition, the mounting portion 146 of the wire-holder channel 142 is at an angle 150 relative to the forward portion 136 of the spread-tube holder 120 so that the tube 10 and the wire 50 can then be more easily pulled forward together to advance rearward portions of the tube 10 and wire 50 into and through the tool 110 for mounting. The angle 150 is typically less than about 90 degrees, for example it is about 30 degrees in the depicted embodiment. Thus, according to some example embodiments, the angle 150 is generally an acute angle of less than about 90 degrees. In some embodiments, the channel mounting portion includes a bend such that it enters the spread-tube holder forward portion at the angle then bends into alignment with the spread-tube holder forward portion so that at the spread-tube holder forward-release point the spread-tube holder and the wire-holder channel are coaxial.

The handle 116 provides a location for a user to grasp and hold the tool 110 for ease of use. The handle 116 can be in the form of a flat disk sized relatively small for pinching between two fingers (as depicted), an elongated handgrip, or another structure suitable for grasping by a user during the intended use of the tool 110, or the shell-like tube retainer 140 can also function as a handle so that a separate grasping structure is not needed or included. The handle 116 can include finger stops 152 extending transversely outward against which a user can position fingers for use. In addition, the wire-holder channel 142 can include a feed portion 154 rearward of and continuous with its mounting portion 146 for ease of use, with the feed portion positioned on the handle 116. The feed portion 154 of the wire-holder channel 142 can be positioned on the handle 116 where the user can easily place a finger over it to hold the wire 50 in it during a portion or all of the use of the tool 110 if desired, for example to pull the tube 10 forward on the wire without also advancing the wire (see, e.g., FIG. 15A).

Figure 13A:
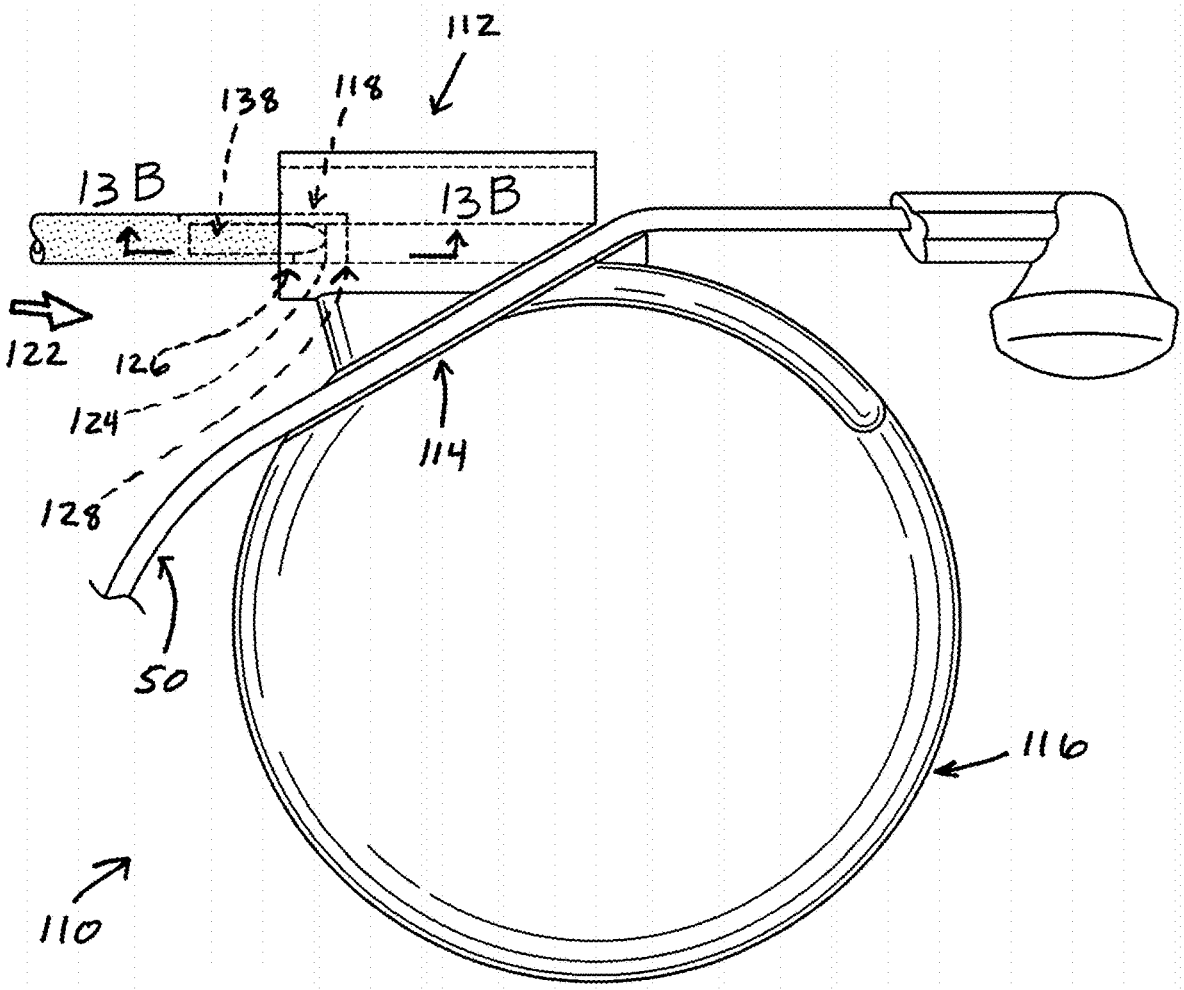
FIG. 13A shows the side view of FIG. 12, wherein the end of the wire-protector is moving on the tube feed in a tube-advancing direction, and whereby a longitudinal slit starting at the end of the wire-protector is generally spread apart by transversely-ramped surfaces.
Figure 13B:
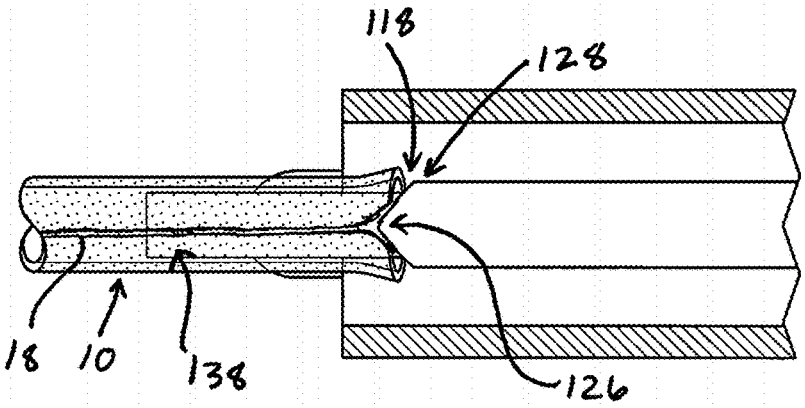
FIG. 13B is a cross-sectional view of FIG. 13A taken along line 13B-13B.

Having described details of the structure of the tool 110, its use will now be described with reference to FIGS. 12-16. In FIG. 12, with the wire 50 placed in the wire-holder channel 142, the handle 116 is gripped by the user with one hand (e.g., by positioning the thumb and forefinger of one hand against the two finger stops 152) and the tube 10 is gripped by the user with the other hand to advance the tube relative to the tube spreader 118 forward in the tube-advancing direction toward the tube spreader. In FIGS. 13A-B, with the tube 10 positioned on the tube-feed rod 138, the tube is moved forward in the tube-advancing direction 122 into engagement with the ramped surfaces 124 of the tube spreader 118 to begin spreading open the longitudinal slit 18 of the tube from its neutral closed/retention position to it open/access position.

Figure 14B:
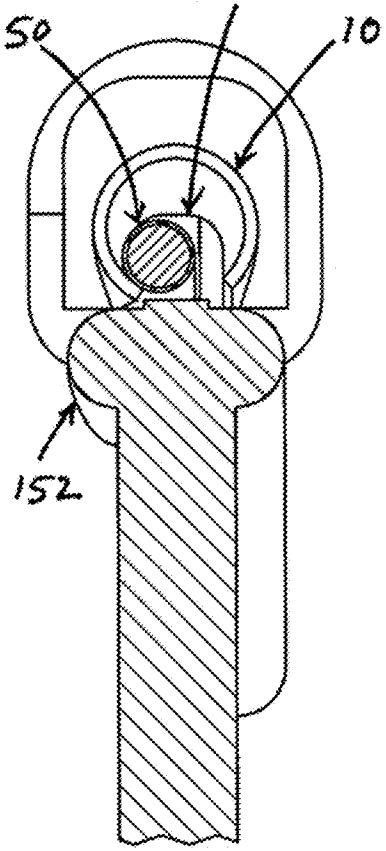
FIG. 14B is a cross-sectional view of FIG. 14A taken along line 14B-14B.
Figure 14C:
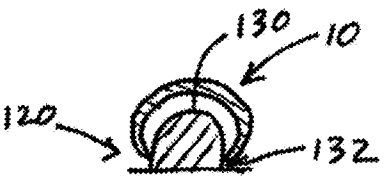
FIG. 14C is a cross-sectional view of FIG. 14A taken along line 14C-14C.
Figure 14A:
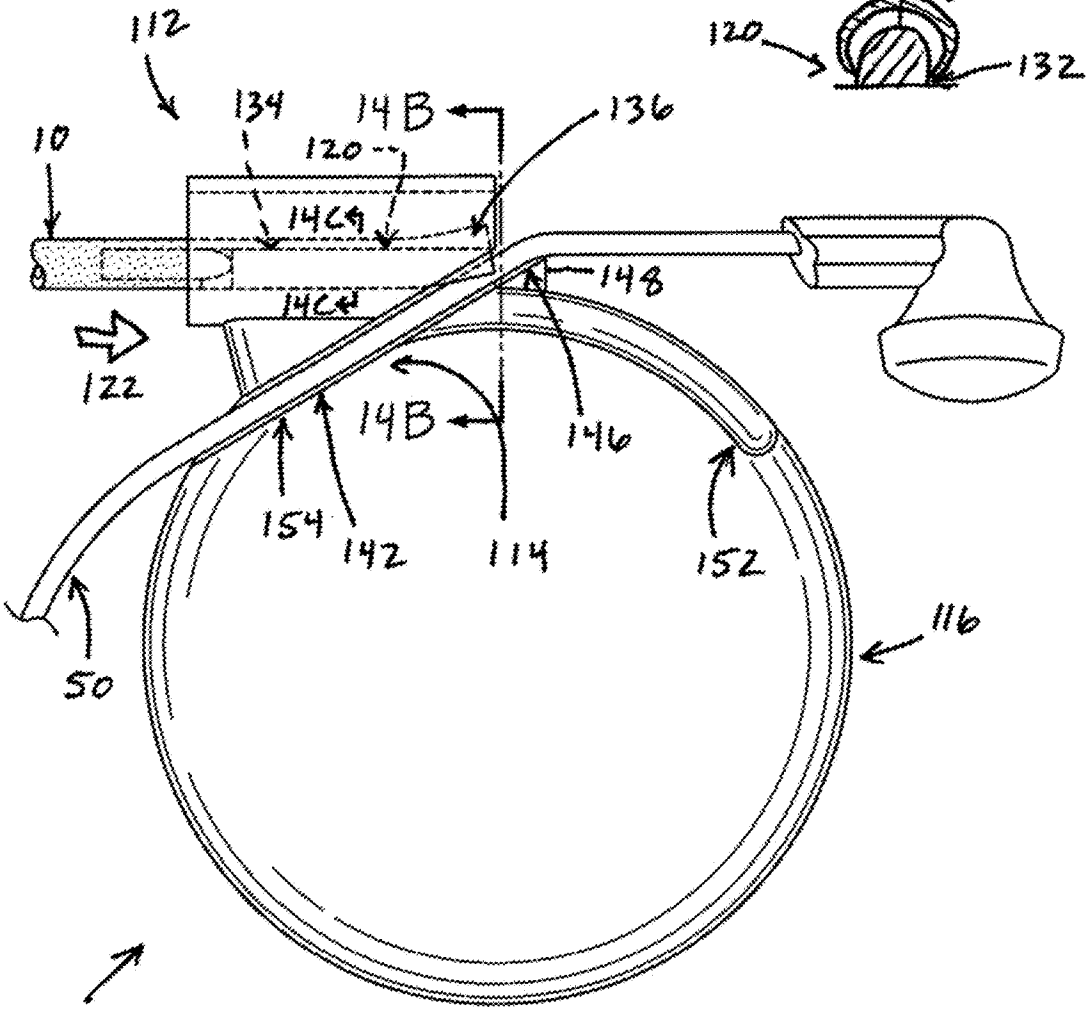
FIG. 14A shows the side view of the FIG. 13A, wherein the end of the wire-protector is further positioned along the tube-mounting assembly and whereby an end thereof is displace such that the slit is open and begins to receive the wire.
Figures 15A, 15B:
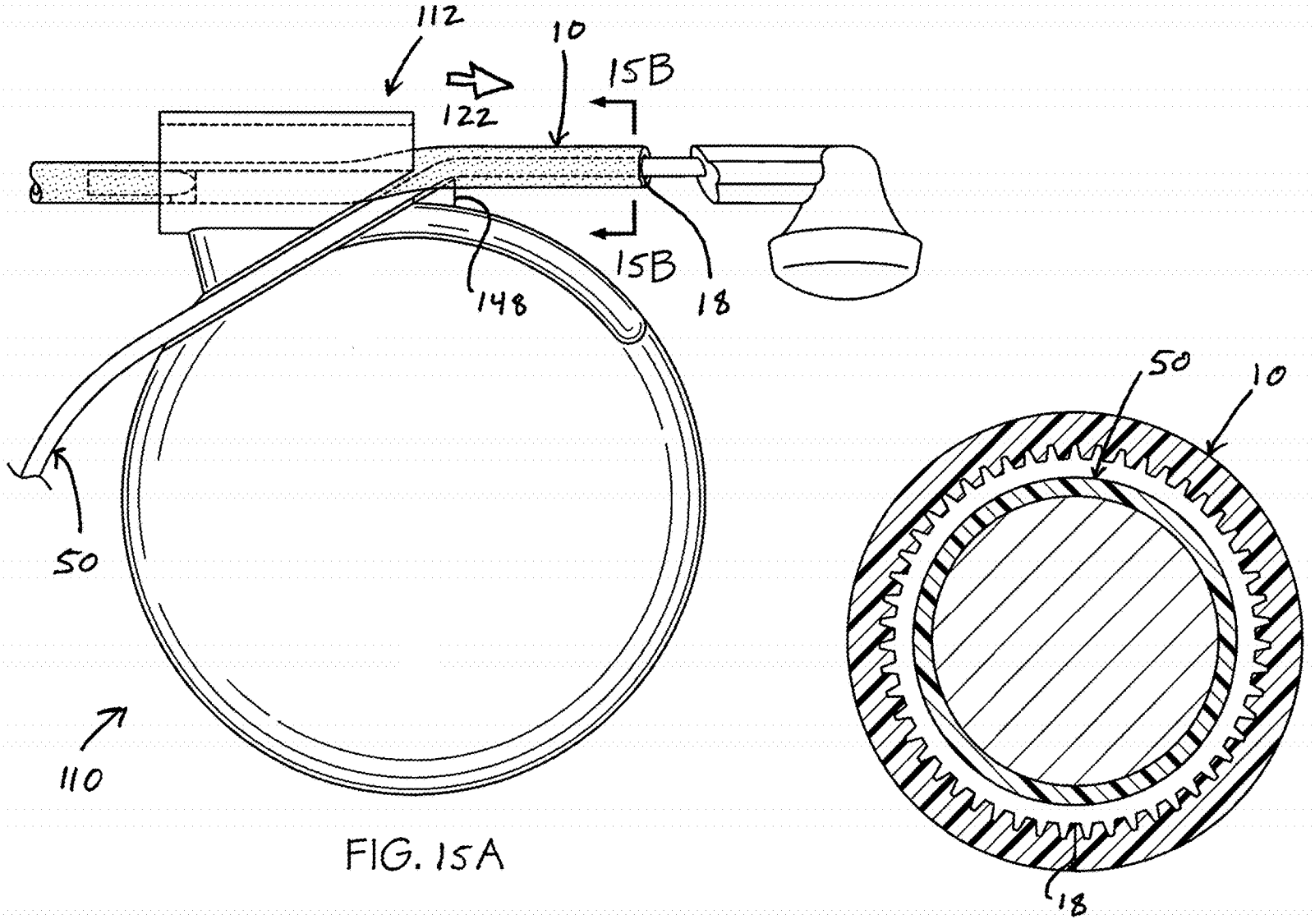
FIG. 15A shows the side view of FIG. 14A, wherein the end of the wire-protector is further positioned along the tube-mounting assembly such that an end thereof already being passed therethrough is generally closed at its slit thereof and has encased the wire therein.
FIG. 15B is a cross-sectional view of FIG. 15A taken along lines 15B-15B.

With the tube 10 spread open at its slit 18 by the tube spreader 118, the tube is pushed forward in the tube-advancing direction 122 along the spread-tube holder 120 with the tube slit held in the spread-open position, as shown in FIG. 14C. In FIGS. 14A-B, the spread-open tube 10 is pushed forward in the tube-advancing direction 122 onto the forward portion 136 of the spread-tube holder 120 so that the spread-open tube is slid over the mounting portion 146 of the wire-holder channel 142 and the wire 50 held in it. In FIGS. 15A-B, the tube 10 is pushed forward in the tube-advancing direction 122 along the wire 50 until its forward portion has passed the forward-edge tube-release point 148 of the spread-tube holder 120, so the longitudinal-slit edges of the tube resiliently return to the closed/access position so that the tube forward portion at least substantially surrounds the wire forward portion. The user can place a finger over the feed portion 154 of the wire-holder channel 142 (and the wire 50 held in it) to frictionally hold the wire from advancing along with the tube 10 until the forward portion of the tube is in a desired position on the wire, as may be helpful for example between the positions of FIGS. 14A-B and 15A-B.

Once the forward portion of the tube 10 is advanced into the desired position on the wire 50 (e.g., as shown in FIG. 15A), the forward portion of the tube 10 can be grasped (forward of the tube-mounting assembly 112) in a pinching fashion and pulled forward in a joint-advancing direction 156. In this way, the forward portion of the tube 10 and the forward portion of the wire 50 radially inside it can be pulled forward together in the joint-advancing direction 156 to advance rearward portions of the tube 10 and wire 50 into and through the tube-mounting assembly 112 for mounting. The tube 10 and wire 50 can be forwarded together in this manner until the entire desired lengths of the tube and the wire have been processed by the tool 110.

In yet another aspect of the invention, the tube 10 can include internal ribs for enhanced gripping on the wire 50 (e.g., as shown in FIG. 15B). The ribs can extend radially inward and longitudinally along the entire length of the tube 10. The ribs can be evenly spaced, with flat/truncated inner caps, with a valley between them and with the valleys having flat/truncated outer bottoms.

In yet another aspect, the present invention relates to a method of covering a wire with a protective sleeve. The sleeve includes a generally uniform slit extending the length thereof and wherein the slit is generally configured such that in a neutral position, the slit is generally in closed. The method includes providing a tool having a tube-mounting assembly and a wire holder, the tube-spreader assembly having a tube spreader and a spread-tube holder, the wire holder having a channel for holding the wire relative to the tube-mounting assembly; positioning the wire within the channel of the wire holder, the wire being movable relative to the channel; positioning the protective sleeve such that an end thereof engages the tube-spreader and the spread-tube holder of the tube-mounting assembly; moving the protective sleeve relative to the tube-mounting assembly; positioning the wire exiting an end of the channel to be positioned within the protective sleeve, the slit being displaced to an access position when the wire exiting the end of the channel is entering the protective sleeve; and moving the protective sleeve relative to the tube-mounting assembly while the wire is moved through the channel of the wire holder and through an opening of the slit in the access position, wherein after the slit passes an end portion of the spread-tube holder, the slit generally moves back to a neutral position with the slit closed and substantially covering the wire therein.

It is to be understood that this invention is not limited to the specific devices, methods, conditions, or parameters described and/or shown herein, and that the terminology used herein is for the purpose of describing particular embodiments by way of example only. Thus, the terminology is intended to be broadly construed and is not intended to be limiting of the claimed invention. For example, as used in the specification including the appended claims, the singular forms "a," "an," and "one" include the plural, the term "or" means "and/or," and reference to a particular numerical value includes at least that particular value, unless the context clearly dictates otherwise. In addition, any methods described herein are not intended to be limited to the sequence of steps described but can be carried out in other sequences, unless expressly stated otherwise herein.

While the invention has been shown and described in exemplary forms, it will be apparent to those skilled in the art that many modifications, additions, and deletions can be made therein without departing from the spirit and scope of the invention as defined by the following claims.

What is claimed is:

1. A monolithic one-piece skinner tool for securing a protective sleeve to a wire, the protective sleeve comprising a longitudinal slit running the length thereof, the skinner tool comprising:

a tube-mounting assembly having a tube spreader, a spread-tube holder and a tube retainer, the tube retainer surrounding the tube spreader and spread-tube holder so as to define a U-shape void therebetween; and a wire holder having a channel for holding the wire relative to the tube-mounting assembly, the channel being at least partially open and accessible so as to permit at least a portion of the wire to be seated therein, wherein at least a portion of the channel is formed with at least a portion of the spread-tube holder, wherein the protective sleeve is advanced relative to the tube-mounting assembly such that the tube spreader and the spread-tube holder displace the slit running the length of the protective sleeve at a position adjacent an end portion of the channel of the wire holder and with the tube retainer surrounding the entirety of the protective sleeve that is engaged with the spread-tube holder, and wherein advancing the protective sleeve in a tube-advancing direction and when the wire is at least partially within the protective sleeve and movable along the channel of the holder allows for positioning of the wire within the protective sleeve, and wherein after the engagement thereof whereby the wire is positioned within the protective sleeve, further advancement of the protective sleeve causes disengagement with the spread tube holder, thereby freeing the slit to close around the wire.

2. The skinner tool of claim 1, wherein the tube spreader includes at least one transversely-ramped surface such that it is transversely wider along its length in the tube-advancing direction so that it is received in the tube slit and then spreads open the tube slit as the tube is advanced along it.

3. The skinner tool of claim 2, wherein the tube spreader includes two symmetrical transversely-ramped flat surfaces forming a relatively narrow rear that is receivable in the elongate slit of the tube and a relatively wide front that is wider than the wire.

4. The skinner tool of claim 1, wherein the spread-tube holder is positioned immediately forward of the tube spreader in the tube-advancing direction.

5. The skinner tool of claim 4, wherein the spread-tube holder includes a first axially-extending peripheral portion around which the spread tube is received and a second axially-extending peripheral portion with a transverse width that is wider than the wire so that it holds the slit spread open.

6. The skinner tool of claim 5, wherein the spread-tube holder comprises a semi-cylindrical solid shape such that the first peripheral portion is curved to receive the protective sleeve around it, and wherein the second peripheral portion comprises a similar width as the first peripheral portion.

7. The skinner tool of claim 1, further comprising a handle for providing a location for a user to grasp and hold the tool for ease of use.

8. The skinner tool of claim 7, wherein the handle is in the form of a flat disk sized relatively small for pinching between two fingers, an elongated handgrip, or another structure suitable for grasping by a user during the intended use of the tool.

9. The skinner tool of claim 1, wherein the channel of the wire holder is configured for slidingly receiving the wire therein so that the wire is transversely stable while permitting the wire to be forwarded axially in an advancing direction toward the tube.

10. The skinner tool of claim 1, wherein the channel is formed by a continuous recess.

11. The skinner tool of claim 1, wherein the channel of the wire holder includes a mounting portion that extends through a forward portion of the spread-tube holder.

12. The skinner tool of claim 1, wherein the skinner tool is formed from a plastic material.

* * * * *